US005778790A

United States Patent [19]

Peterson

[11] Patent Number: 5,778,790

[45] Date of Patent: Jul. 14, 1998

[54] TRANSFER OF COMPUTER IMAGES TO LITHOGRAPHIC PLATES EMPLOYING PETROLEUM DISTILLATES AS THE TRANSFER AGENT

[76] Inventor: Richard Peterson, 60 W. Center St., Ventura, Calif. 93001

[21] Appl. No.: 707,510

[22] Filed: Sep. 4, 1996

[51] Int. Cl.[6] ..... B41C 1/10; B41C 1/06

[52] U.S. Cl. ..... 101/463.1; 101/472; 156/236

[58] Field of Search ..... 101/463.1, 465, 101/466, 467, 468, 472; 156/236

[56] References Cited

U.S. PATENT DOCUMENTS

| | | | |
|---|---|---|---|
| 89,715 | 5/1869 | Vogt et al. | 101/467 |
| 184,132 | 11/1876 | Biedermann | 101/467 |
| 2,086,011 | 7/1937 | Whitmore | 101/472 |
| 3,386,822 | 6/1968 | Brynko | 101/465 |
| 3,554,125 | 1/1971 | Van Dorn | 101/451 |
| 3,649,117 | 3/1972 | Weigl | 101/471 |
| 3,741,118 | 6/1973 | Carley | 101/451 |
| 3,945,318 | 3/1976 | Landsman | 101/401.1 |
| 4,157,974 | 6/1979 | Brechlin et al. | 252/62.1 L |
| 4,444,858 | 4/1984 | Nishibu et al. | 430/49 |
| 4,967,210 | 10/1990 | Frazier | 346/150 |
| 5,073,218 | 12/1991 | Aggio | 101/472 |
| 5,213,043 | 5/1993 | Reimers et al. | 101/463.1 |
| 5,379,698 | 1/1995 | Nowak | 101/454 |
| 5,384,225 | 1/1995 | Kurotori | 430/116 |

*Primary Examiner*—Stephen R. Funk
*Attorney, Agent, or Firm*—Tom Hamill, Jr.

[57] ABSTRACT

A method permitting a fine artist to transfer a computer generated image to a lithographic plate is provided. Any computer image may be utilized including photographs or drawings which have been electronically scanned into the computer. The computer image transfer method includes the use of a petroleum distillate as a solvent. The solvent acts as a transfer agent to transfer the toner from a laser printed image to the lithographic plate. A computer image is generated and printed on a sheet (separation) through the use of a laser printer. Four separations are laser printed in accordance with the CMYK protocols. A RBG separation may alternatively be employed. Each separation has the following steps performed thereon. The separation is placed face down on the lithographic limestone or the like. A porous sheet, with sufficient quantities of solvent entrained therein, is placed on the plate. A piece of metal foil is then placed on the porous sheet. The tympan is then placed. This is then taken through the press several times. The solvent induces the toner to leave the separation and under the pressure of the pressing transfers it to the lithographic limestone. This provides a printing surface which has improved qualities over hand printing, as well as the benefits of an exact pixel to pixel correspondence between the image on the lithographic limestone and the computer generated digital image.

6 Claims, 1 Drawing Sheet

The Steps of the Transfer Method

The Steps of the Transfer Method

TRANSFER OF COMPUTER IMAGES TO LITHOGRAPHIC PLATES EMPLOYING PETROLEUM DISTILLATES AS THE TRANSFER AGENT

BACKGROUND OF THE INVENTION

1. Field of the Invention

The present invention relates generally to lithography, and more particularly, to a method of transferring the toner pattern from a computer generated image printed by a laser printer to a lithographic limestone or aluminum plate employing a petroleum distillate as the image transfer agent.

2. Description of the Prior Art

No methods have been proposed to transfer computer generated images, such as those generated by artists on a personal computer, onto a lithographic plate. The use of the personal computer to create fine art has reached new popularity with the dissemination of personal computer technology. Lithographic printing has long been known in the fine art community and has desirable characteristics. Current personal computer technology has placed the artist in a position to generate via a laser printer, a series of separated (CMYK) computer generated images. These images may be simply and inexpensively transferred to lithographic substrates permitting the subsequent printing of the computer generated images using lithographic techniques. This method is simple and safe and places the capacity to transfer such digital images to any artist who is familiar with lithographic techniques.

SUMMARY OF THE INVENTION

To achieve the foregoing and other advantages, the present invention, briefly described, provides a method permitting an artist to transfer a computer generated (or provided) image to a lithographic plate. The computer image transfer method includes the use of a petroleum distillate as a solvent. The solvent is utilized as a transfer agent to transfer the toner from a laser printed image to the lithographic plate. A computer image is generated which may include scanned images, including scanned images of photographs. These images may be provided to the computer by any of a variety of means, including magnetic storage medium, CD-ROM, Internet downloads etc. The artist (user) may generate their own image on software, or may modify an already provided image. This image is color separated by the computer. The resulting separations are then printed on a sheet of ordinary paper through the use of a laser printer. Four separations of the color separated digital image are laser printed. Each individual separation has the following steps performed thereon. The separation is placed face down on the lithographic limestone or the like. Porous sheet material, with sufficient quantities of petroleum distillate entrained therein, is placed on the plate. A piece of aluminum foil is then placed atop the porous sheet. The tympan is then placed. The resulting stack is then taken through the press several times. The solvent induces the toner to leave the separation and under the pressure of the pressing transfers it to the lithographic limestone. This provides a printing surface which has improved qualities over hand printing, as well as the benefits of a digital image. Care has to be taken with the amount of petroleum distillate employed, insufficient quantities will prevent the complete transfer of the image.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new method to transfer computer provided images which have been printed using a conventional laser printer to lithographic plates for subsequent lithographic printing employing a petroleum distillate at the transfer agent.

An object of the present invention is to provide a new method for artists to mate personal computer technology with lithography, in a simple, inexpensive and environmentally friendly manner.

An object of the present invention is to use an inexpensive and safe solvent such as gasoline as the transfer agent.

An object of the invention is to provide a lithographic method which will permit the lithographic limestone to accept new washes without counteretching. This method permits tusche washes to be added directly over the transfer.

A further object of the invention is to provide a transfer method which produces archival images.

And a further object of the invention is to provide a positive printing plate. Using a laser printed image invalidates the requirement for a negative image to be provided.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
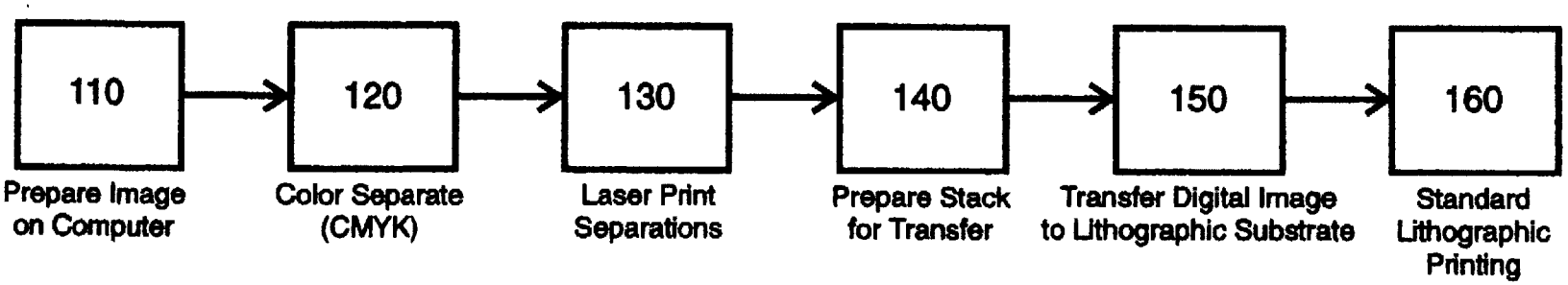
FIG. 1 is a block diagram showing the method employed in the transfer of computer images to lithographic plates employing petroleum distillates as the transfer agent.

With reference now to the drawing, a new method of transferring computer generated images to lithographic substrates embodying the principles and concepts of the present invention will be described.

Referring now to the block diagram of the method denoted by FIG. 1, there is shown a first exemplary embodiment of the transfer process of the invention. In order to transfer the computer images to lithographic limestone or aluminum, a computer generated image 110 must first be prepared. Any of a variety of computer art generation software exists which may permit an artist to render a computer generated image. The image may also be a photograph or other depiction scanned into the computer.

The image must then be color separated 110. The CMYK separation protocol is available on several of the commercially available software packages including Adobe Photoshop. This would separate the computer image into the four component colors, generally C for cyan, M for magenta, Y for yellow and K for black. The software permits printing of each of the CMYK images separately. Other software may separate the colors under the RBG protocol. This separation would be in three component colors, namely Red, Blue and Green. The instant method would work with these separations as well. As a matter of fact, any laser printed image may be transferred using this method.

The color separations are then laser printed 130. The printing is preferably performed by the laser printer on an ordinary paper page. Each page is known in the art as a separation and includes the portion of the image which has been color separated by the software. One separation is printed for each of the colors, therefore, a C-plate, M-plate, Y-plate and K-plate are all printed by the laser printer. Further, registration marks may preferably be employed. Some software packages utilize very small registration marks which have been found to be insufficient for the instant method. Generally speaking, the artist will provide larger T-bar registration guides on the computer image, which will be present in the four printed separations. This will permit proper alignment of the separations throughout the process.

At this point the stack is prepared for toner transfer 140. Once the color separated laser printed image is on the paper, the paper is placed face down on a lithographic limestone. It is to be understood that this discussion may equally apply to other lithographic substrates such as an aluminum plate. Also, the lithographic limestone will be referred to as the stone for the sake of this discourse. It is important to insure that the stone has been properly grained and leveled. This will provide the best transfer of the toner from the laser printed image, for if the stone is not perfectly level the transfer will not be consistent in tone and quality.

A sheet of porous material is cut generally to the size of the image. The porous material is then soaked with a petroleum distillate such as gasoline. It has been found that newsprint or the like works well as a porous medium. It is considered probable that other solvents may be entrained in the porous material. Gasoline may be chosen for its accessibility, cost and relative environmental friendliness. When gasoline and newsprint are employed in the process, the newsprint has the gasoline entrained therein by soaking or other means. An inking slab may be utilized to perform this function, by placing an amount of gasoline on the slab, one may mop it up with the newsprint. Other methods may be employed without deviating from the instant method of the invention. As a result of the soaking, the newsprint will become translucent. At this point, the newsprint will have any excess gasoline removed by permitting the gasoline to simply drip off the newsprint under the action of gravity. After the excess is removed, it is placed atop the image on the separation. Experience will show exactly how much gasoline should remain entrained in the newsprint to actualize optimum results. A sheet of aluminum foil is then placed atop the newsprint, and the resultant three layer laminate has a backing sheet placed thereon. The backing sheet is a sheet of stiff paper that is placed intermediate the stack and the tympan.

Now the stack is ready to be placed in the press to transfer the digital image to the lithographic substrate 150. The tympan is placed in alignment under the scraper bar and has a row of tympan grease placed thereon the same width as the scraper bar. Pressure is established and the press engaged, the grease permits the smooth motion of the scraper bar over the tympan. The entire stack is then cranked through the press 3–6 times at printing pressure.

After the pressing, the stack, including the tympan, aluminum foil, newsprint and paper image separation plate is removed from the stone. The stone would then have an exact mirror image of the image which was present on the color separated paper placed thereon, leaving the toner footprint on its surface. Also, residual gasoline may be present on and about the transferred toner image on the face of the stone. This should be fanned until the gasoline is evaporated.

The stone or aluminum plate is further prepared. Rosin, talc and etch the stone with straight gum arabic. Alternatively, a mixture of 6 grains tannic acid and 1 ounce of gum arabic may be employed. Other etching solutions are known in the art. The stone is then permitted to cure at room temperature for a minimum of 20 minutes. At this point the gum is to be removed with water and a sponge.

The stone is then to be rolled up with black printers ink or the like. This involves taking a leather roller and applying the black printers ink over the surface of the stone which has had the image placed thereon. The stone is then etched mildly once more, using a weak nitric acid solution with gum arabic, or the above mentioned tannic acid.

At this point in the process the stone is ready to print the single color separated digital image which has been transferred to the stone by conventional and well known lithographic printing techniques 160.

After printing the first color separated image, the lithographic limestone must be prepared for the next color separated digital image to be placed thereon. The toner which has been transferred to the lithographic limestone from the prior color separated laser printer image leaves a much stronger pixel image on the limestone than conventional techniques such as grease pencil etc. As such the counter etching step may be performed up to three times and possibly more. The stone will be counter etched by using one part glacial acetic acid to 10 parts distilled water. This would be applied three times in order to remove the previous etching completely. Dry the stone between and after the counter etching.

The above process would then be repeated for the additional three laser printed color separated digital images, via steps 140, 150 & 160, and including the post printing washing step. The end result would be a lithograph of the computer generated image with a one to one pixel correspondence. A photograph may be scanned into the computer and simply transferred to the stone permitting a lithograph of unparalleled quality to be efficiently, cost effectively and simply created.

Other advantages are obtained through the use of this process including allowing the lithographic limestone to accept new washes without counteretching. This method permits tusche washes to be added directly over the transfer. The resultant washes are crisper, cleaner and very easy to print. The laser toner is the reason for the adherence of the wash to the stone. This gives the capacity to print the plate as intended and go back after the printing is finished and rework the imagery to give it a hand done quality. This is possible because there is a 'ghost' image on the stone. After the color plate is finished, wash the image with lithotine and using the ghost image as a guide, paint directly on top of the 'ghost' image related values of tusche. Permit the washes to dry thoroughly and etch as per standard lithographic techniques.

Another advantage of the process is that it provides an archival image of digital imagery generated by the computer. Currently, the best computer printer inks degrade rapidly. The best inks and printers currently only last 30 years. By employing this method with lithographic hand printing standards, including acid free paper and lithographic ink, the resulting image may last hundreds of years.

It is apparent from the above that the present invention accomplishes all of the objectives set forth by providing a new method to transfer computer provided images which have been printed using a conventional laser printer to lithographic plates for subsequent lithographic printing employing a petroleum distillate as the transfer agent.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A method for transferring a laser printed image on a sheet of paper to a lithographic substrate comprising the steps of:

generating an image on a computer, printing said image on a sheet of paper by employing a laser printer, placing said sheet of paper atop said lithographic substrate, covering said sheet of paper with a porous paper sheet, said porous paper sheet having gasoline entrained therein, covering said porous paper sheet with a metal foil, covering said metal foil with a tympan, forming a stack, pressing said stack in a press, whereby said gasoline permits said laser printed image to be transferred from said sheet of paper to said lithographic substrate under the urging of said pressing.

2. A method of transferring a laser printed image on a sheet of paper to a lithographic substrate as claimed in claim 1 wherein said lithographic substrate is lithographic limestone.

3. A method of transferring a laser printed image on a sheet of paper to a lithographic substrate as claimed in claim 1 wherein said lithographic substrate is an aluminum plate.

4. A method of transferring a laser printed image on a sheet of paper to a lithographic substrate including the steps of:

a) generating an image on the computer, b) color separating said image, c) printing said color separated images on a laser printer, d) placing a first of said images atop said lithographic substrate, e) covering said image with a porous sheet, said sheet having a solvent entrained therein, f) covering said porous sheet with a foil, g) covering said foil with a substrate, forming a stack, h) pressing said stack in a press, i) removing said lithographic substrate from said stack, j) etching said lithographic substrate, k) applying ink to said lithographic substrate, l) print said lithographic substrate, m) wash and counteretch said lithographic substrate, n) repeat steps d–m with each one of said images, whereby said image generated on the computer is lithographically and archivally reproduced.

5. A method of transferring a laser printed image on a sheet of paper to a lithographic substrate as claimed in claim 4 wherein said computer image is formed from an image which has been scanned into the computer by a scanner.

6. A method of transferring a laser printed image on a sheet of paper to a lithographic substrate as claimed in claim 4 wherein said computer image is formed from an image which has been entered into the computer by a portable magnetic storage medium or a CD-ROM.

* * * * *